US008015766B2

(12) United States Patent
Gosling et al.

(10) Patent No.: US 8,015,766 B2
(45) Date of Patent: Sep. 13, 2011

(54) MOVABLE WALLS FOR ON-SITE CONSTRUCTION

(75) Inventors: Geoff Gosling, Calgary (CA); Mogens Smed, De Winton (CA)

(73) Assignee: Dirtt Enviromental Solutions, Ltd., Calgary (CA)

( * ) Notice: Subject to any disclaimer, the term of this patent is extended or adjusted under 35 U.S.C. 154(b) by 926 days.

(21) Appl. No.: 11/742,591

(22) Filed: May 1, 2007

(65) Prior Publication Data

US 2007/0251180 A1 Nov. 1, 2007

Related U.S. Application Data

(60) Provisional application No. 60/796,422, filed on May 1, 2006.

(51) Int. Cl.
*E04B 2/82* (2006.01)
*E04B 2/00* (2006.01)

(52) U.S. Cl. ..... 52/239; 52/482; 52/800.12

(58) Field of Classification Search ..... 52/238.1, 52/239, 243.1, 578, 582.1, 474, 476, 481.2, 52/482, 772, 773, 781.3, 126.3, 800.12, 800.14
See application file for complete search history.

(56) References Cited

U.S. PATENT DOCUMENTS 3,037,593 A * 6/1962 Webster ..... 52/476
4,103,874 A * 8/1978 Horgan, Jr. ..... 256/24
4,356,672 A * 11/1982 Beckman et al. ..... 52/36.6
4,821,476 A * 4/1989 Thoburn et al. ..... 52/238.1
4,852,317 A * 8/1989 Schiavello et al. ..... 52/239
5,125,201 A * 6/1992 Pieters et al. ..... 52/238.1
5,152,113 A * 10/1992 Guddas ..... 52/238.1
5,207,037 A * 5/1993 Giles et al. ..... 52/126.6
5,546,718 A * 8/1996 Way ..... 52/238.1
6,023,896 A * 2/2000 Rothschild ..... 52/243.1
6,047,508 A * 4/2000 Goodman et al. ..... 52/241
6,108,989 A * 8/2000 Kordes et al. ..... 52/243.1
6,128,877 A * 10/2000 Goodman et al. ..... 52/242
6,158,179 A * 12/2000 Ackerly et al. ..... 52/220.7
6,250,020 B1 * 6/2001 Shipman ..... 52/36.1
6,260,321 B1 * 7/2001 Rudduck ..... 52/474
6,295,764 B1 * 10/2001 Berridge et al. ..... 52/36.5
6,517,056 B2 * 2/2003 Shepherd ..... 256/24
6,883,277 B2 * 4/2005 Wiechecki et al. ..... 52/36.6
6,964,410 B1 * 11/2005 Hansen ..... 256/24
6,993,875 B2 * 2/2006 Rudduck ..... 52/474
7,036,799 B2 * 5/2006 Shepherd ..... 256/73
7,090,226 B1 * 8/2006 Trainor et al. ..... 277/630
7,434,790 B1 * 10/2008 Hansen ..... 256/24
7,458,190 B2 * 12/2008 Isaac et al. ..... 52/396.03
7,488,013 B2 * 2/2009 Urpolahti ..... 292/179

(Continued)

*Primary Examiner* — Khoi Tran
*Assistant Examiner* — Jason Holloway
(74) *Attorney, Agent, or Firm* — Workman Nydegger

(57) ABSTRACT

A system for partitioning an interior space includes a plurality of slotted, horizontal and vertical frame components configured for stable, permanent or temporary mountings. In one implementation, the frame components are configured to receive a plurality of different panels, such as glass or resin panels (or panes). The panels can be assembled with the frame components on site into virtually any length or shape, and can further be removed and replaced on-site as needed or desired without necessarily requiring complicated deconstruction efforts. In one implementation, a manufacturer can prepare a preliminary assembly. The manufacturer can then insert a plurality of different panels therein in any horizontal or vertical alignment. The manufacturer can then position an end frame-component to complete the sub-assembly after the different panels are inserted therein.

18 Claims, 9 Drawing Sheets

U.S. PATENT DOCUMENTS

| | | | | |
|---|---|---|---|---|
| 7,730,682 | B2 * | 6/2010 | Nash | 52/238.1 |
| 7,814,711 | B2 * | 10/2010 | Milligan et al. | 52/126.4 |
| 7,866,636 | B1 * | 1/2011 | Hansen | 256/65.14 |
| 2002/0157335 | A1 * | 10/2002 | Vos | 52/238.1 |
| 2003/0089057 | A1 * | 5/2003 | Wiechecki et al. | 52/238.1 |
| 2003/0110726 | A1 * | 6/2003 | Rudduck | 52/474 |
| 2003/0205010 | A1 * | 11/2003 | Anglin et al. | 52/238.1 |
| 2009/0241445 | A1 * | 10/2009 | Sprague | 52/243.1 |
| 2010/0307082 | A1 * | 12/2010 | Nash | 52/238.1 |

* cited by examiner

MOVABLE WALLS FOR ON-SITE CONSTRUCTION

CROSS-REFERENCE TO RELATED APPLICATIONS

The present invention claims the benefit of priority to U.S. Provisional patent Application No. 60/796,422, filed on May 1, 2006, entitled "Movable Walls Configured to be Constructed On-Site," the entire contents of which are incorporated by reference herein.

BACKGROUND

Background and Relevant Art

Office space can be relatively expensive, not only due to the basic costs of the location and size of the office space, but also due to any construction needed to configure the office space in a particular way. For example, an organization might purchase or rent a large open space in an office complex, and then subdivide or partition the open space into various offices, conference rooms, or cubicles, depending on the organization's needs and size constraints. In general, the organization will typically subdivide the office space with virtually any type of material, such as standard dry wall and frame materials, as well as any usage of glass, resin, or even more modular, cubicle-style materials. The choice of these materials generally reflects decisions having to do with aesthetic considerations, relative permanence of the subdivisions, and, ultimately, costs.

In general, organizations opting for temporary partitions, such as cubicle-style, or modular partitions, tend to sacrifice aesthetics in favor of rapid configurability or reuse/rearrangement, and lower costs. By contrast, organizations that favor more aesthetically pleasing partitions, tend to sacrifice the ability to rearrange office space partitions, and typically pay much higher costs from start to finish. This tends to be the case for a number of different reasons. For example, the more aesthetically pleasing materials, such as glass or resin panels, tend to be more expensive than modular components, and further tend to require more expensive, permanent mountings. This is at least partly since these types of panel materials tend to be much heavier and more fragile than other types of materials used in a partition.

Accordingly, with permanent partitions, the manufacturer will typically build customized wood and dry wall frames that are tailored to the size of each glass or resin panel, where the frames securely hold the glass or resin panel in place. In other cases, the manufacturer might build a customized frame around each particular panel, and secure each frame (that includes the panel) to a floor, wall, and/or ceiling support structure. In any event, these more permanent structures allow a manufacturer to position several panels in the same permanent mounting structure or partition. In addition, and in the event the manufacturer frames two different panels side-by-side together, the manufacturer may also apply a relatively permanent seal between the two different panes, such as by applying a silicone caulk. One can appreciate that these types of approaches to positioning and securing a panel as a partition can be time consuming, and can be expensive.

Furthermore, the relative permanence of the mounting materials can make it fairly difficult to change the configuration of the office space, or can otherwise limit the type of configuration outlay. For example, removing a set of frame panels that are encased in a wood frame typically involves destroying the wood frame, and/or cleaning the silicone caulking off of the panels, and then rebuilding the wood frame for another area where the panels may be positioned again. Thus, removing the panels and configurations often involves acts that cause many or all of the partition materials to be unusable to greater or lesser degrees. In particular, reconfiguration of the office partitions will result in discarding (or spending significant time restoring) many of the components used in the partitions themselves.

By contrast, and as previously mentioned, the more-light weight, cubicle-style walls can be much easier to assemble, more reusable, and much less expensive. For example, with modular components, the manufacturer can simply position the partitions in a particular pattern, and temporarily secure the partitions to a wall, floor, or ceiling structure in some cases such as with fasteners. The manufacturer may even also use rollers at the bottom of the modular subdividing components to roll the subdividing components in and out of a particular subdivision position. Unfortunately, these more modular, reusable materials, also tend to be less aesthetically pleasing, and often do not provide many of the privacy benefits generally found with more permanent partition structures.

In many cases, therefore, an organization may desire to implement some combination of permanent and semi-permanent/temporary (or modular) materials. In some cases, the organization may even desire to incorporate the benefits of a semi-permanent or modular subdivision with the heavier, and ultimately more aesthetically pleasing, glass or resin panel-type materials. As previously mentioned, however, such heavier-weight materials typically need either a complete frame around the materials on each side, or some sort of permanent framing system about a set of materials in order to secure the weight thereof in a particular position.

Unfortunately, temporary frame components tend to be highly visible, such as by requiring a modular frame on all sides of the material to hold the panel in place. This heightens visibility of the frame components, which can hinder the otherwise-intended aesthetic (e.g., transparency or translucence) for the panel in the partition, and can create obstructions where a continuous or design look may be desired. For example, a completely framed panel typically limits a manufacturer to angled alignments, and can make curved alignments difficult or impossible.

Thus, although modular configurations can provide for more rapid installation and reconfiguration of walls/partitions, the size, arrangement, and aesthetics of such partitions tends to be fairly limited, particularly compared with conventional permanent mounting solutions. These limitations of modular configurations can be further compounded by the size and characteristics of each interior office space, including the size of entry doors or elevators, or the handling weight of the divider wall, and so forth. That is, although permanent partitions can be assembled and created with a variety of different finishes to appear as a continuous unit of almost any dimension, modular partitions tend to resemble a compilation of segments that are no larger than the door or elevator dimension through which they were received.

Accordingly, there are a number of difficulties associated with dividing interior office space with high quality, aesthetically pleasing materials, particularly in light of cost considerations, and where the need for reconfiguration and reuse of such components may be desired.

BRIEF SUMMARY

Implementations of the present invention provide systems, apparatus, and methods for assembling and re-assembling partitions of an interior space using high grade partitioning components. In particular, implementations of the present invention comprise a number of different frame components that can hold a wide range (weight, style, size) of panel materials, such as high-end glass or resin panel materials, in a stable formation against a given support structure, but without requiring permanent mounting solutions. The partitioning components used in accordance with the present invention can provide a permanent-style partition (e.g., sets of continuous, and/or curved panel alignments) while, at the same time, being capable of reuse and realignment as needed without destruction.

For example, a partitioning system for partitioning an interior space on a semi-permanent or temporary basis with a plurality of different panels can include a first horizontal frame component configured to be removably mounted to a support surface. The first horizontal frame component includes a slot therein for receiving an edge of at least one panel. The system can also include a first vertical frame component mounted to the first horizontal frame component on a lower end. The first vertical frame component also includes a slot therein for receiving an edge of at least one panel. In addition, the system can include a second horizontal frame component mounted to an opposing upper end of the first vertical frame component. The second as horizontal frame also includes a slot therein for receiving an edge of at least one panel.

Furthermore, the system can include a gasket positioned in each of the slots in each of the horizontal and vertical frame components. In general, the slots of the first and second horizontal frame component, and of the first vertical frame component, are configured in size and shape to removably receive any of the at least one panels and/or a plurality of different panels.

In addition, a method of partitioning an interior space on-site with reusable modular components configured to removably hold a plurality of heavy-weight panels in a stable conformation that is permanent or temporary can include a step for creating a preliminary assembly for removably receiving a plurality of different panels. This step can include attaching a first horizontal frame component to a support surface, where the first horizontal frame component has a slot. The step for creating the preliminary assembly can also include attaching an end of a first vertical frame component to an end of the first horizontal frame component, where the first vertical frame component has a slot.

Furthermore, the step for creating the preliminary assembly can include attaching an end of a second horizontal frame component to an opposing end of the first vertical frame component. As with the other two components, the second horizontal frame component also has a slot. The method can also involve sliding a plurality of different panels within one or more slots corresponding to the frame components of the preliminary assembly. In addition, the method can involve attaching opposing ends of a second vertical frame component to corresponding opposing ends of the first and second horizontal frame components.

This Summary is provided to introduce a selection of concepts in a as simplified form that are further described below in the Detailed Description. This Summary is not intended to identify key features or essential features of the claimed subject matter, nor is it intended to be used as an aid in determining the scope of the claimed subject matter.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

Implementations of the present invention relate generally to systems, apparatus, and methods for assembling and reassembling partitions of an interior space using high grade partitioning components. In particular, implementations of the present invention comprise a number of different frame components that can hold a wide range (weight, style, size) of panel materials, such as high-end glass or resin panel materials, in a stable formation against a given support structure, but without requiring permanent mounting solutions. The partitioning components used in accordance with the present invention can provide a permanent-style partition (e.g., sets of continuous, and/or curved panel alignments) while, at the same time, being capable of reuse and realignment as needed without destruction.

Accordingly, one will appreciate that implementations of the present invention can be particularly suited to walls or partitions used in an office interior environment where both aesthetics and low cost are desired. In addition, and as will be appreciated more fully herein, implementations of the present invention provide design freedom. For example, the components in accordance with implementations of the present invention can be easily manufactured off-site, and subsequently assembled into virtually any permanent-style configuration on-site. In particular, components in accordance with the present invention provide for the assembly of large, continuous or semi-continuous runs of panels used as partitions, which would otherwise need permanent framing apparatus.

In addition, the components in accordance of the present invention are low-profile with respect to the panels (or panes) they are holding, such that their visibility with respect to the panels is minimize. In particular, the use of any intervening, non-structural elements located between adjacent panels can be significantly minimized. As a result, stable and reconfigurable partition alignments can be provided in almost any angle or curvature, and in a manner that highlights—rather than hinders—the aesthetics of the panel used in the partition.

For ease of reference, the panes, sheets, or panels used in the movable walls, are referred to generically herein as "panels" and panel or partition assemblies. Partitions that are assembled on-site using structural supports and panels can also be generally referred to as "stick-built" panels, while the components that generally provide the structure about the panels in the partition are generally referred to herein as "frame components." Thus, a partition (i.e., "stick built" wall or partition) will be understood herein to include at least one lower or bottom horizontal frame component, at least one upper or top horizontal frame component, and, at least initially, a single vertical frame component, wherein a manufacturer can insert a panel into the frame created thereby.

Figure 1:
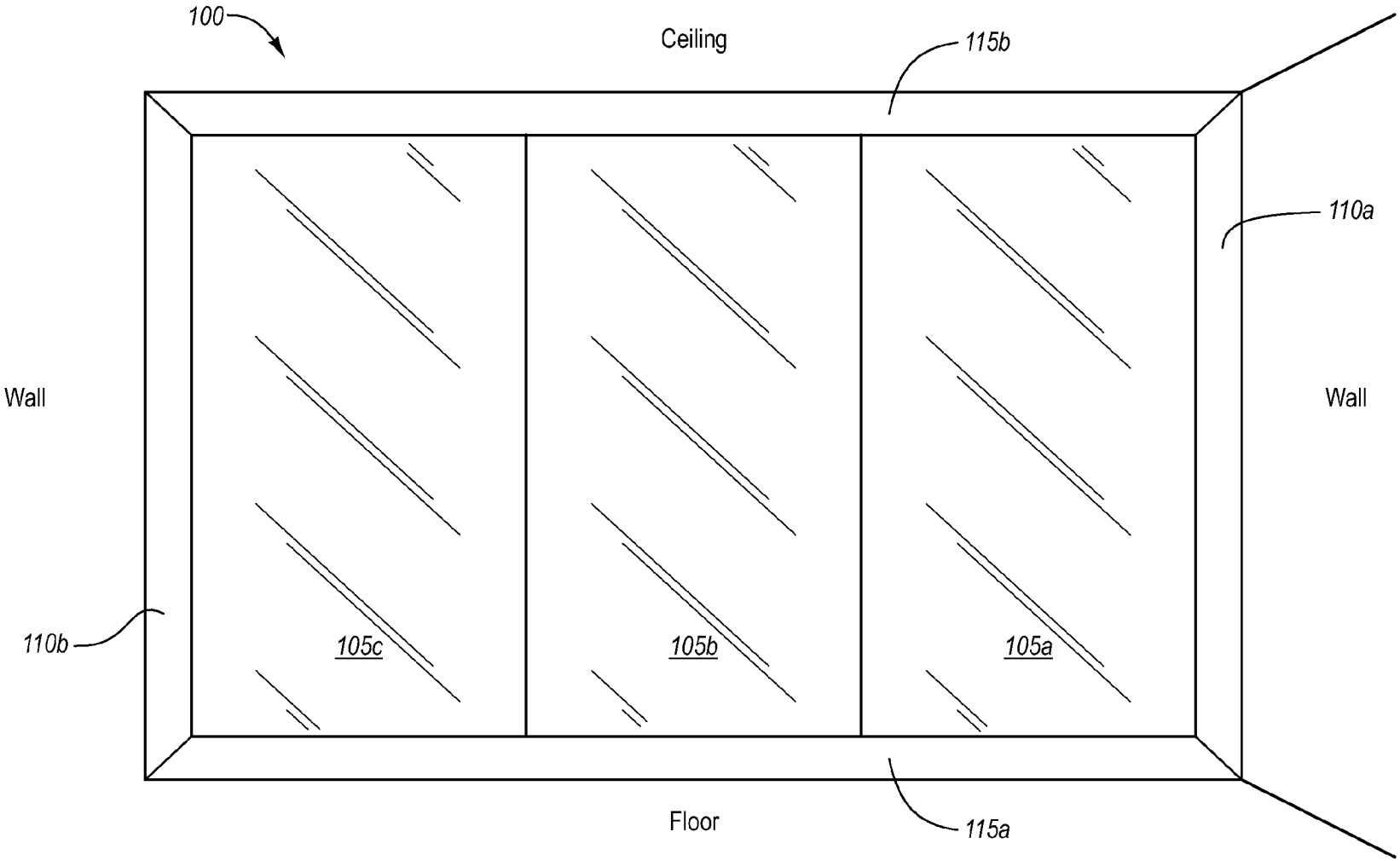
FIG. 1 illustrates a partition in accordance with an implementation of the present invention in which a plurality of panels are aligned vertically.

For example, FIG. 1 illustrates a partition 100 built using one or more frame components and panels in accordance with an implementation of the present invention. In particular, FIG. 1 shows that at least one form of a semi-permanent or temporary partition 100 can include a first (or bottom/lower) horizontal frame component 115*a*, and a second (or upper) horizontal frame component 115*b*. The partition 100 can also include a first vertical frame component 110*a*, and a second vertical frame component 110*b*. In addition, FIG. 1 shows that each of frame components 110*a-b* and 115*a-b* are positioned adjacent each other, and at least partially secured together, by virtue at least of their alignment within the frame component assembly.

As a preliminary matter, one will appreciate that whether a particular frame component is a "first," "second," "upper," or "lower" horizontal component (or a "leftward"/"rightward") vertical frame component can be somewhat arbitrary. That is, one will understand more fully from the following specification and claims that there may be some instances in which a "first" vertical frame component 110*a* is used in a different position or orientation (e.g., horizontal, interspersed between panels) from what is shown in FIG. 1. Similarly, there may be instances in which the first or "second" horizontal frame components are used in a different position or orientation (e.g., vertical, interspersed between panels) other than what is shown in FIG. 1. Thus, the designations herein of "first," "second," "upper," or "lower" are not meant to connote a specific order of assembly, or required position in an assembly, but primarily to distinguish one particular frame component from the other, or to refer to a particularly illustrated implementation or arrangement.

In any event, FIG. 1 shows that the partition 100 can comprise a plurality of different panels 105*a-c* that are held in place by only one lower horizontal frame component and only one upper horizontal frame component. In general, the horizontal and vertical frame components can be formed or extruded from virtually any material, although portable lightweight materials will generally be preferred. For example, the horizontal or vertical frame components can comprise any number synthetic or naturally occurring polymeric materials, metal materials, and composites thereof. Furthermore, the horizontal and vertical frame components can be formed to virtually any size, length or dimension, so long as they are sufficiently portable and as capable of being passed through a doorway or elevator in one form or another.

For example, FIG. 1 shows that the horizontal frame components 115*a-b* are of a sufficient length that a plurality of different panels 105 are mounted therein. In at least one implementation, for example, the lower and upper frame components 115*a-b* are approximately 12' in length, while each panel 105*a-c* is approximately 4' in width. As such, three different panels 105*a*, 105*b*, and 105*c* are mounted along the length of the lower and upper frame components 115*a-b*, while the three different panels each follow the height of the partition. In this example, therefore, fewer than all of the different panels 105 are held by any given vertical frame component 110.

Thus, FIG. 1 shows at least one advantage of the present invention, wherein each given panel 105*a-c* need not necessarily be surrounded by frame components on all sides. That is, each given panel 105*a-c* could directly contact or interface another given panel edge, in some cases without any intervening seal or holding component. Such a mounting can be done without sacrificing any sense of stability or sense of permanence for the overall partition 100. This is true virtually regardless of the size, weight, look, or feel of the given panel 105*a-c*. For example, any or all of panels 105*a-c* can comprise virtually any size or type of material, including heavy weight glass or resin materials, which heretofore may have required more permanent frames structures to hold them in place. In particular, the panels 105*a-c* need only be configured in size and shape at (at least) two edges, so that the two edges can be inserted within given slots of an adjacent horizontal and/or vertical frame component.

Figure 2A:
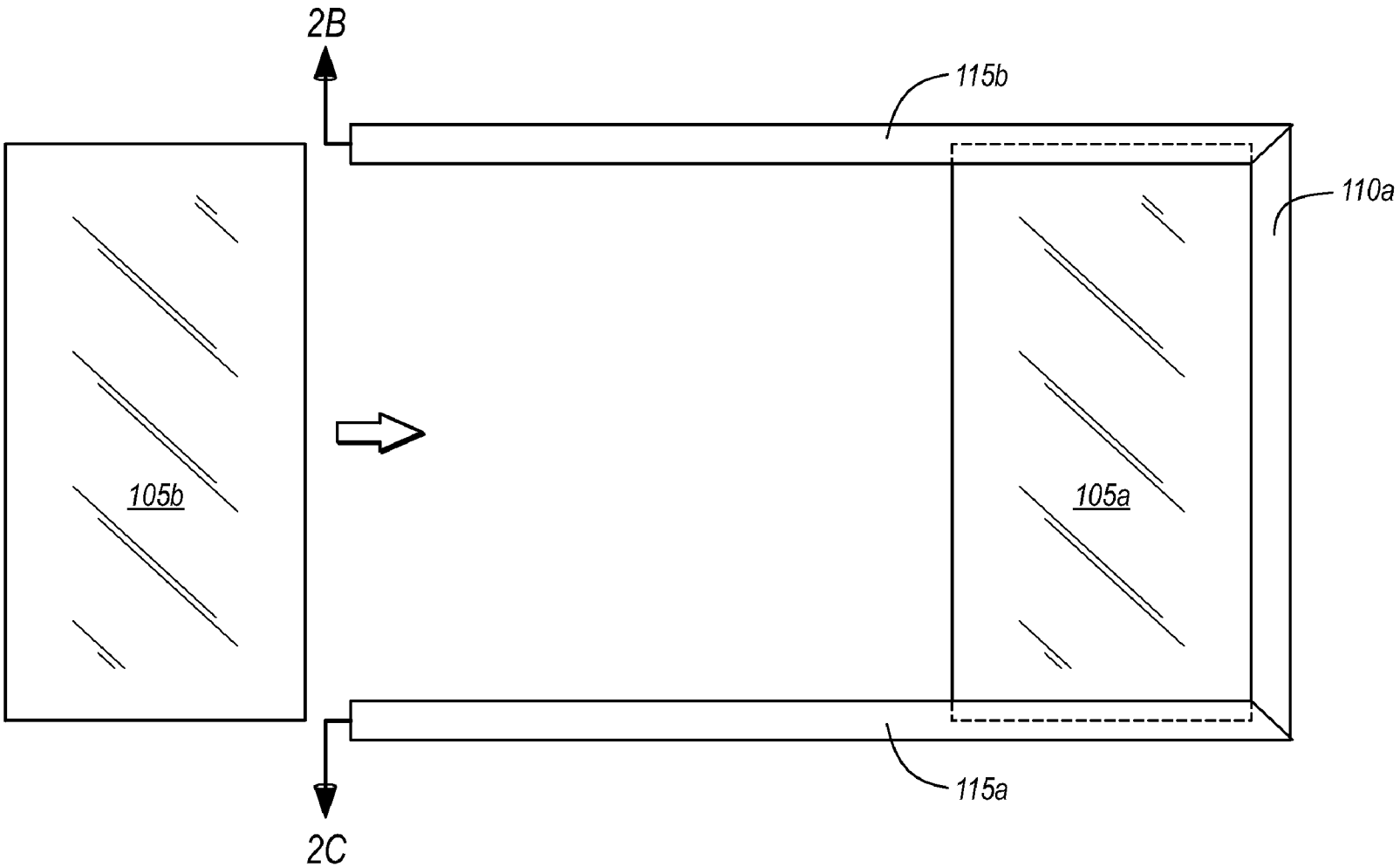
FIG. 2A illustrates a preliminary assembly of the partition of FIG. 1.

Along these lines, FIG. 2A illustrates the partition of FIG. 1 as it is being assembled in accordance with one or more implementations of the present invention. As shown, a manufacturer (or "assembler") creates a preliminary partition assembly 103 into which the manufacturer can slide or otherwise insert the plurality of different panels 105*a-c*. For example, FIG. 2A shows that the manufacturer can position the bottom horizontal frame component 115*a* in a particular or desired position. The manufacturer can then secure an end of the bottom horizontal frame component 115*a* to an end of vertical frame component 110*a*, and secure an end of top horizontal frame component 115*b* to an opposing end of the vertical frame component. As such, the resulting structure may have a generally U (or C)-shaped profile.

Figure 2B:
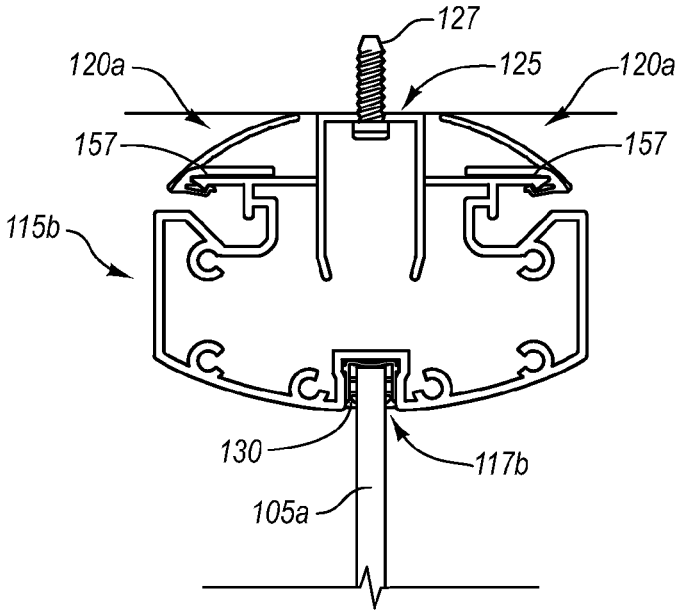
FIG. 2B illustrates a cross-section of an upper frame component used in the partition of FIG. 1.
Figure 2C:
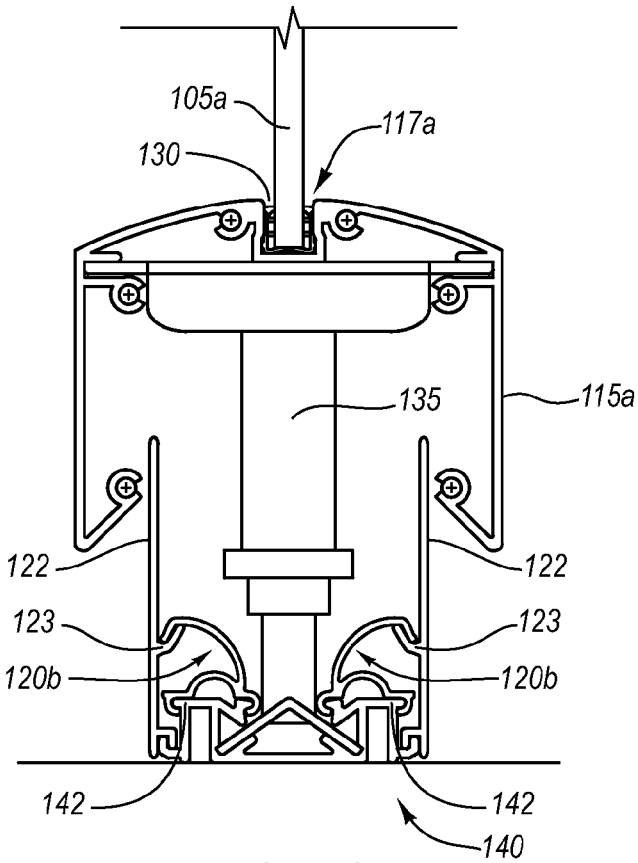
FIG. 2C illustrates a cross-section of a lower frame component used in the partition of FIG. 1.

Thereafter (or prior to creating all of the preliminary assembly 103), the manufacturer may also secure the bottom horizontal frame component 115*a* to a lower guide track 140 (FIG. 2C). In at least one implementation, for example, the manufacturer can secure guide track 140 to a support surface (e.g., floor), and then secure the lower horizontal frame component 115*a* to guide track 140. In order to accommodate any variation in wall or ceiling height, the manufacturer can also perform any vertical adjustments through the lower horizontal frame component 115*a*.

For example, FIG. 2C shows that lower horizontal frame component 115*a* can also include a leveler assembly 135. In general, leveler assembly can include any components for vertical adjustment, such as components operating on rotational, hydraulic, or otherwise graduated adjustment mechanisms. Once lower frame component 115*a* is in position, the manufacturer can then adjust upward or downward the leveler assembly 135, as needed, which, in turn, raises or lowers preliminary assembly 103 relative to the ceiling or floor.

In at least one implementation, and with the preliminary assembly in place, the manufacturer can then begin sliding or otherwise positioning each panel 105*a-c* into the preliminary assembly. For example, FIG. 2A shows that the manufacturer as first inserts panel 105*a* into position so that at least one edge of panel 105*a* is within a slot of horizontal frame components 115*a-b* and vertical frame component 110*a*. For example, and with further respect to FIGS. 2B, 2C, and 3A, panel 105*a* is inserted into slots 113 and 117.

In at least one implementation, and prior to inserting the panel 105 into these slots, the manufacturer may also position one or more gaskets 130 in any or all of the slots 113, 117, etc. of each frame component 110, 115. In general, one will appreciate that gasket 130 can be used to accommodate any variations in width or dimension between an edge of a panel 105 and the width or dimension of a given slot 113, 117, etc. Gasket 130 can also be used to accommodate any expansion or contraction that occurs with a given panel or frame to ensure a stable mounting interface. Accordingly, gasket 130 can give partition 100 a sense of stability typically provided only by more permanent components, and even though gasket 130 is capable of being moved and reused.

Figure 3D:
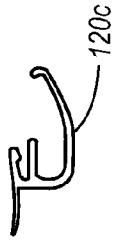
FIG. 3D illustrates a flexible insert in accordance with an implementation of the present invention that is used to mount a partition against or to a modular wall.
Figure 3C:
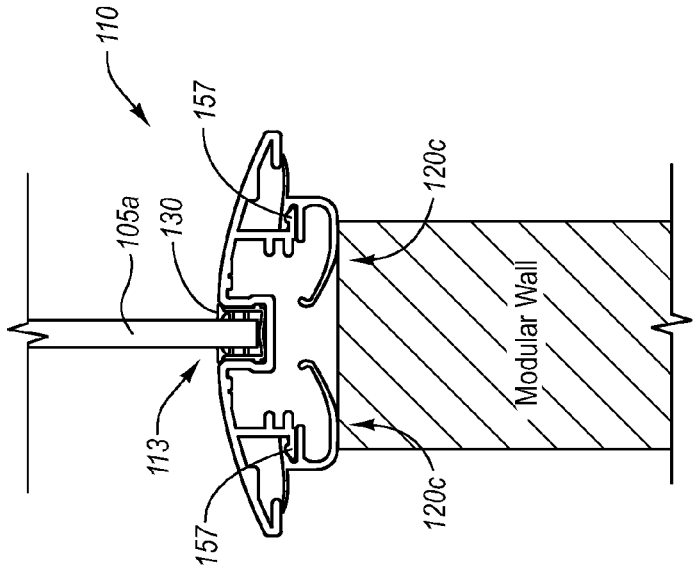
FIG. 3C illustrates a plan view of the vertical frame component mounted to or positioned against a modular wall without a fastener.
Figure 3B:
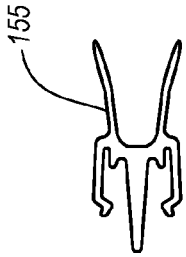
FIG. 3B illustrates a clip in accordance with an implementation of the as present invention, which is used to attach the vertical frame component of FIG. 3A to a mounting plate.
Figure 3A:
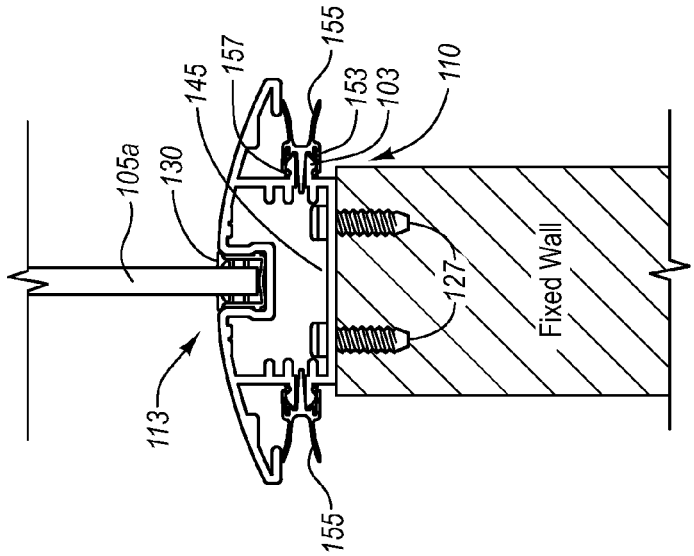
FIG. 3A illustrates a plan view of a vertical frame component in accordance with an implementation of the present invention when the component is attached to a wall.

Accordingly, FIGS. 2B, 2C, and 3A show that gasket 130 has been positioned between an edge of a given panel and the inside surface of a given slot. This can occur any number of different ways. For example, the manufacturer may position gasket 130 directly inside each given slot 113, 117, etc., or may alternatively position gasket 130 on each edge of the given panel before insertion into a particular slot. In at least one implementation, gasket 130 is a length of flexible material having flexible internally-facing wings or flanges positioned within a flexible gap or slot. Gasket 130 can be provided in a lengths of flexible or rubber-based materials that are placed along an entire length of a frame component slot. Alternatively, gasket 130 can be provided in small, discrete units that are positioned at specific points along a particular frame component or panel edge.

In addition to the foregoing, FIGS. 2B-2C, and 3A-3C illustrate in more detail a number of additional components that can also be used to stably mount or align the above-mentioned components in position. For example, FIGS. 2B and 2C show that a manufacturer can attach or otherwise include one or more different types of flexible inserts 120*a*-120*b* (see also 120*c*, FIG. 3C) at the mounting interfaces. In particular, FIG. 2B shows that, on an upper horizontal frame component 115*a*, the manufacturer can include flexible insert 120*a*. In this illustration, flexible insert 120*a* is configured in size and shape to hold a portion 157 of interface 125 of frame component 115*a*, and to flexibly abut a ceiling structure as a form of adjustable trim.

As with the frame components, the flexible inserts and/or clips described herein can comprise any number of suitable materials, including any number of synthetic or naturally occurring plastics, rubber compounds, or metals, and/or composites thereof, as desired for a particular look, feel, or function. In at least one implementation, the flexible inserts and/or clips comprise primarily PVC materials. In any event, one will appreciate that the materials of any given flexible insert can add a level of stability and adjustability to a given mounting interface. With particular respect to FIGS. 2B-2C, the combination of fastener 127, mounting interface 125, and flexible insert 120*a* can add multiple levels of adjustability and overall stability to preparation and use of partition 100.

By contrast, flexible insert 120*b* shown in FIG. 2C is used primarily to flexibly hold or clip one or more interface portions 142 of lower guide track 140 to one or more interface portions 123 of trim 122. In one implementation, for example, the manufacturer first aligns and/or fastens lower guide track 140 into a position on a support surface, and then positions flexible insert 120*b* thereon. The manufacturer as can then position bottom frame component 115*b* (including leveler assembly 135) about the lower guide track 140 until secured. The manufacturer can then position trim 122 on both sides of the bottom frame component 115*a* until a portion 123 of trim 122 snaps into one or more flanges of the flexible insert 120*b* and/or one or more interface portions 142 (or both) of lower guide track 140.

FIGS. 3A-3D illustrate similar or identical uses of a flexible insert, such as use in various mounting implementations, whether for securing or spacing purposes, or some combination of both. For example, FIG. 3A shows that a vertical frame component 110 can be mounted in a relatively fixed conformation to a support structure, such as a wall or post. To do so, the manufacturer places mounting plate 145 against the wall, and then secures any number of fasteners 127 therein to hold the mounting plate 145 in place. To secure the vertical frame component 110 to the mounting plate 145, the manufacturer then secures a portion 157 of the vertical frame component 110*a* mounting interface to one or more extensions 153 of the base plate 145 using a flexible insert in the form of a clip 155. In one implementation, the manufacturer uses a plurality of clips 155 along the vertical frame component 110 and one or more base plates 145, as needed.

Similarly, FIG. 3C illustrates an implementation in which a flexible insert 120*c* is used at the mounting interface, albeit in a more temporary conformation. In this case, for example, the support structure may be a modular wall, such as a temporary partition wall or support to which tapping a receptacle (and/or positioning fastener 127 in) may be impractical. Accordingly, FIG. 3C shows that a manufacturer can position or otherwise attach flexible insert 120*c* to one or more portions 157 of the vertical frame component 110 mounting interface.

As further shown in FIG. 3D, flexible insert 120*c* is configured in size as and shape to provide a flexible abutment of vertical frame component 110 (and hence the corresponding partition) against the support structure. One can appreciate that the flexibility of flexible insert 120 can provide the manufacturer some adjustability in horizontal positioning, and can further provide a sound or light barrier at this partition/wall joint. In any event, the manufacturer can effectively secure vertical frame component 110*a* against the modular support structure by securing the bottom and/or top frame components 110*a-b* to their respective support surfaces/structures against which they are positioned.

Figure 4:
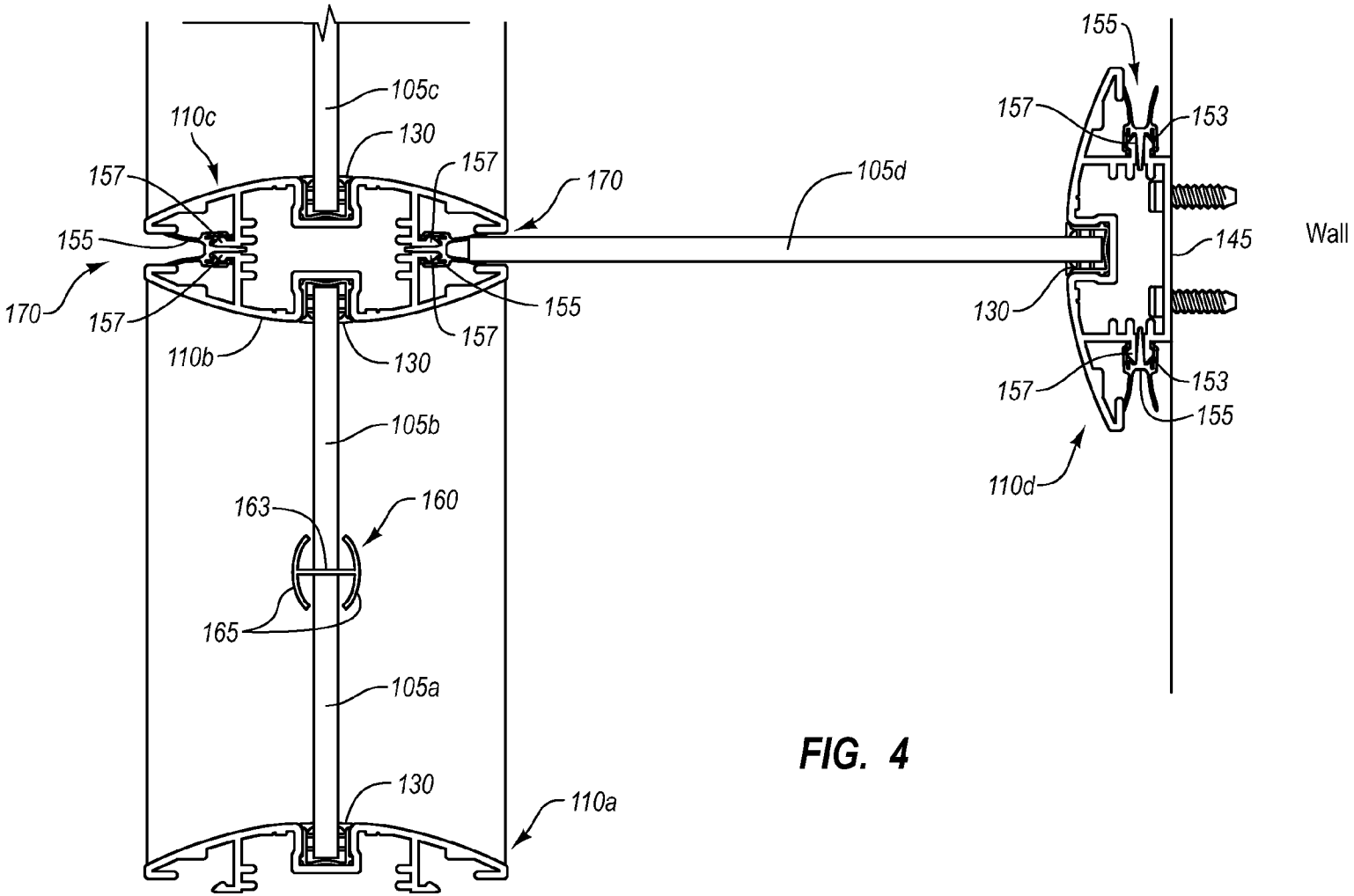
FIG. 4 illustrates a plan view of another implementation of the present invention in which the vertical frame components are combined to create a transverse junction interface for receiving still another panel of another partition.

FIG. 4 illustrates yet another implementation in accordance with the present invention, in which the previously described components are used for additional functions, such as to join one partition with other transverse partitions. For example, a manufacturer may desire to join another partition at an intermediate point (e.g., between two adjacent panels) of partition 100. To do so in at least one implementation, FIG. 4 shows that the manufacturer can position the mounting interfaces of two different vertical frame components 110*b-c* together in an opposed relationship. The manufacturer can then secure portions 157 of the two different mounting interfaces together using clip 155 (e.g., FIG. 3D).

As also shown in FIG. 4, the resulting shape of the adjoined vertical frame components 110*b-c* and clip 155 (when in position) creates another slot 170, which is sufficient in dimension to receive yet another panel. For example, FIG. 4 shows that a manufacturer can insert panel 105*d* into slot 170 created in the adjoined vertical frame components 110*b-c*. As such, panel 105*d* extends in a transverse alignment from panels 105*a*, 105*b*, and 105*c*, such as a substantially perpendicular alignment, as illustrated. One will appreciate, however, that a strictly perpendicular alignment is not necessarily required, and other shapes or designs for slot 170 may be as appropriate to facilitate different transverse (perpendicular or otherwise) alignments of panel 105*d* (or overall partition).

FIG. 4 also shows that the manufacturer has mounted the opposing end of panel 105*d* in this case to another vertical frame component 110*d*. In addition, FIG. 4 shows that, in this case, vertical frame component 110*d* is mounted in a fixed position with the support surface, such as shown in FIG. 3A. One will appreciate, however, that this fixed positioning may not necessarily be required, and the more temporary mounting of FIG. 3C may be more appropriate, depending on alignment or configuration. Furthermore, the mating between vertical frame components 110*a-b* and vertical frame component 110*c* need not necessarily be only one panel long, as illustrated. Rather, a manufacturer can use several different panels in a partition resembling partition 100 (or a longer or shorter length, as desired). As such, FIG. 4 illustrates only one implementation of a possible transverse mating between partitions.

In addition to the foregoing, FIG. 4 shows that the manufacturer can in some cases position a flexible insert between edges of each panel. For example, FIG. 4 shows that the manufacturer has positioned flexible separator 160 between panels 105*a* and 105*b*. In at least one implementation, flexible separator 160 is a clip having a body 163 length that traverses the entire length of any given panel 105. In alternatively implementations, flexible separator 160 is formed in several discrete units that are positioned along a length defined by two different panels 105.

In addition, separator 160 may be transparent or translucent, and can be formed from virtually any appropriate material. In at least one implementation, flexible separator 160 is formed from polyvinyl chloride, or PVC. Flexible separator (160), however, can be formed of any appropriately sturdy and/or flexible synthetic or naturally occurring materials, such as synthetic or naturally occurring resins, plastics, rubber compounds, metal, or composites thereof. As shown in FIG. 4, separator 160 is formed with flanges 165 on opposing sides, which help secure the separator body 163 in a particular position or alignment between two panels. Flanges 165 and body 163 can also help provide a temporary seal or sound barrier between two given panels (e.g., 105*a-b*).

In general, flexible separator 160 will be understood as being a primarily non-structural (or semi-structural), albeit functional, component. As previously described with respect to separating vertically aligned panels 105*a-b*, for example, flexible separator primarily provides in some aspects an added element of stability, but primarily provides a seal or sound barrier. This contrasts with conventional implementations in a manufacturer might have implemented a silicone caulk between two different panels for the same function. In this particular implementation, however, since there is no caulking between panels, the manufacturer can easily reassemble and reuse the panels (e.g., when moving or rearranging the partition into another space) without having to clean and refinish the edge.

Figure 5:
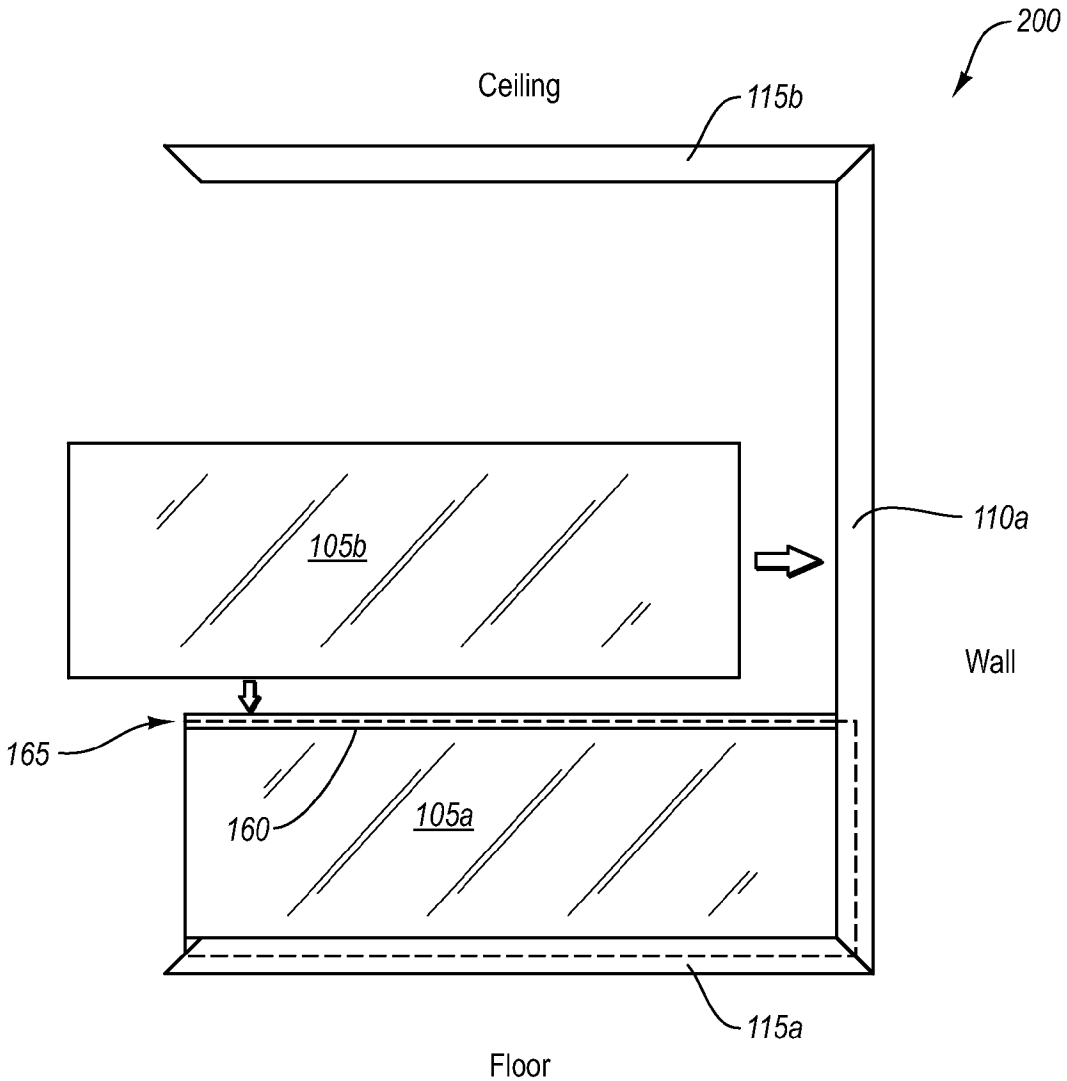
FIG. 5 illustrates a preliminary assembly of a partition in accordance with an implementation of the present invention in which the panels are aligned horizontally.

In some implementations, the potential structural aspects of flexible separator 160 are more apparent when using primarily horizontal panel alignments. For example, FIG 5 illustrates yet another implementation of a preliminary assembly in which the manufacturer is preparing a primarily horizontal panel partition 200. Although flexible separator 160 can be effectively the same shape or design as used in FIG. 4, one will appreciate that, in the implementation of FIG. 5, a stiffer, thicker version of separator 160 may be more appropriate (e.g., see also FIG. 6).

In any event, FIG. 5 shows that the manufacturer can prepare a as preliminary assembly 200 of the partition, as before, by creating a U (or C)-shaped frame using one vertical frame component 110*a* and two horizontal frame components 115*a-b*. Rather than positioning panel 105*a* within this preliminary assembly in a vertical alignment, however, FIG. 5 shows that the manufacturer positions panel 105*a* in slot 117 of component 115*b*, and along the entire length of horizontal frame component 105*a*. Of course, the manufacturer may also include a gasket 130 in each slot 113, 117 of the horizontal or vertical frame components, or along the applicable edges of the panel 105 before insertion.

Accordingly, FIG. 5 shows that the manufacturer positions the flexible separator 160 on top of an edge of panel 105*a*, and positions another panel 105*b* in the same alignment, albeit in between flanges 165 of the separator 160 (e.g., rather than slot 117). Although not shown, the manufacturer can continue this layered approach by positioning another separator 160 on a top edge of panel 105*b*, and positioning yet another panel (e.g., 105*c*) in between the corresponding flanges of separator 160, and thus on top of panel 105*b*. Additional panels 105 may then be aligned and moved into position in a similar manner, as described above. This can be repeated until the preliminary assembly is fully populated with panels.

Thereafter, the manufacturer can position another vertical frame component (e.g., 110*b*) along the exposed edges of the panels, thereby completing the partition. In an implementation in which the horizontal frame components 115*a-b* are approximately the same length as the panels 105 (in horizontal alignment), each horizontal frame component 115 will have only one edge of one given panel 105 positioned in its corresponding slot 117. By contrast, each vertical frame component 110*a-b* will receive multiple panel 105 edges positioned in its corresponding slots 113. Such may be commonly the case with 4'×12' panels, where, when horizontally positioned, three panels are used to reach a partition height of 12' and above.

In much longer alignments, the horizontal frame components 115 could still hold multiple edges from multiple different panels 105 positioned along its corresponding slot 117. Of course, in such an alignment, there will often be another vertical member 110 that separates two horizontally-laid panels. Accordingly, there would still only be one edge of one given panel positioned in a slot of the horizontal frame components 115 as defined by the distance between two different vertical frame components 110 mounted to the given horizontal frame component 115.

Figure 6:
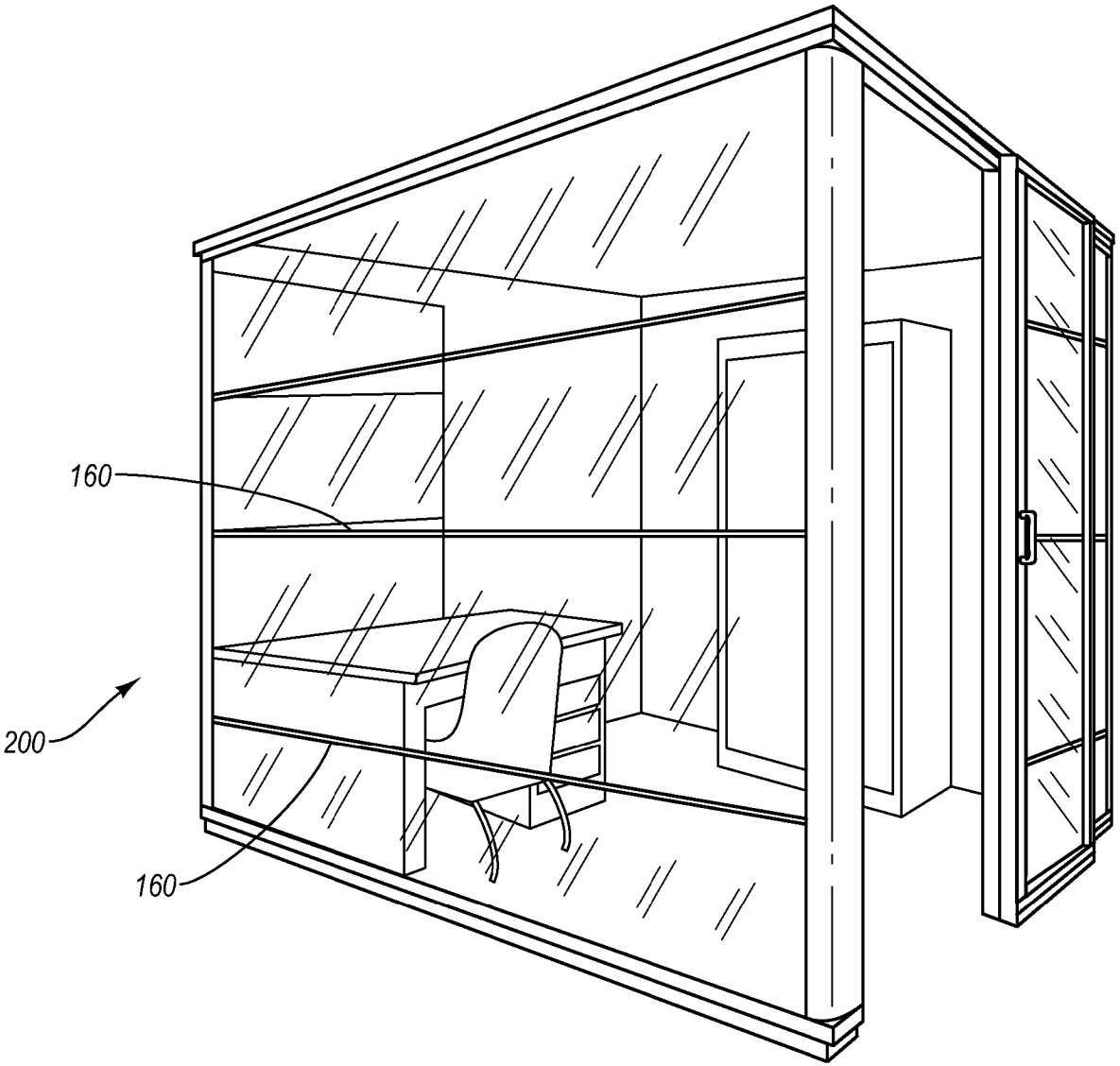
FIG. 6 illustrates a schematic diagram of an implementation of the present invention in which an office space is built using one or more horizontally-aligned partitions.

FIG. 6 illustrates an overview schematic diagram of an implementation of the present invention in which an office space is built using one or more of the horizontally-aligned partitions of FIG. 5. In general, and as previously mentioned, the horizontal assembly can be configured to allow for long runs of glass (or other panel substrates), which typically are joined together with an extrusion (such as flexible separator 160), or a vertical frame component 110. One will appreciate, nevertheless, that the use of horizontal or vertical assemblies as described herein can reduce the quantity—or even eliminate altogether—the use of some vertical frame components that might be otherwise used in conventional installations.

Figure 7:
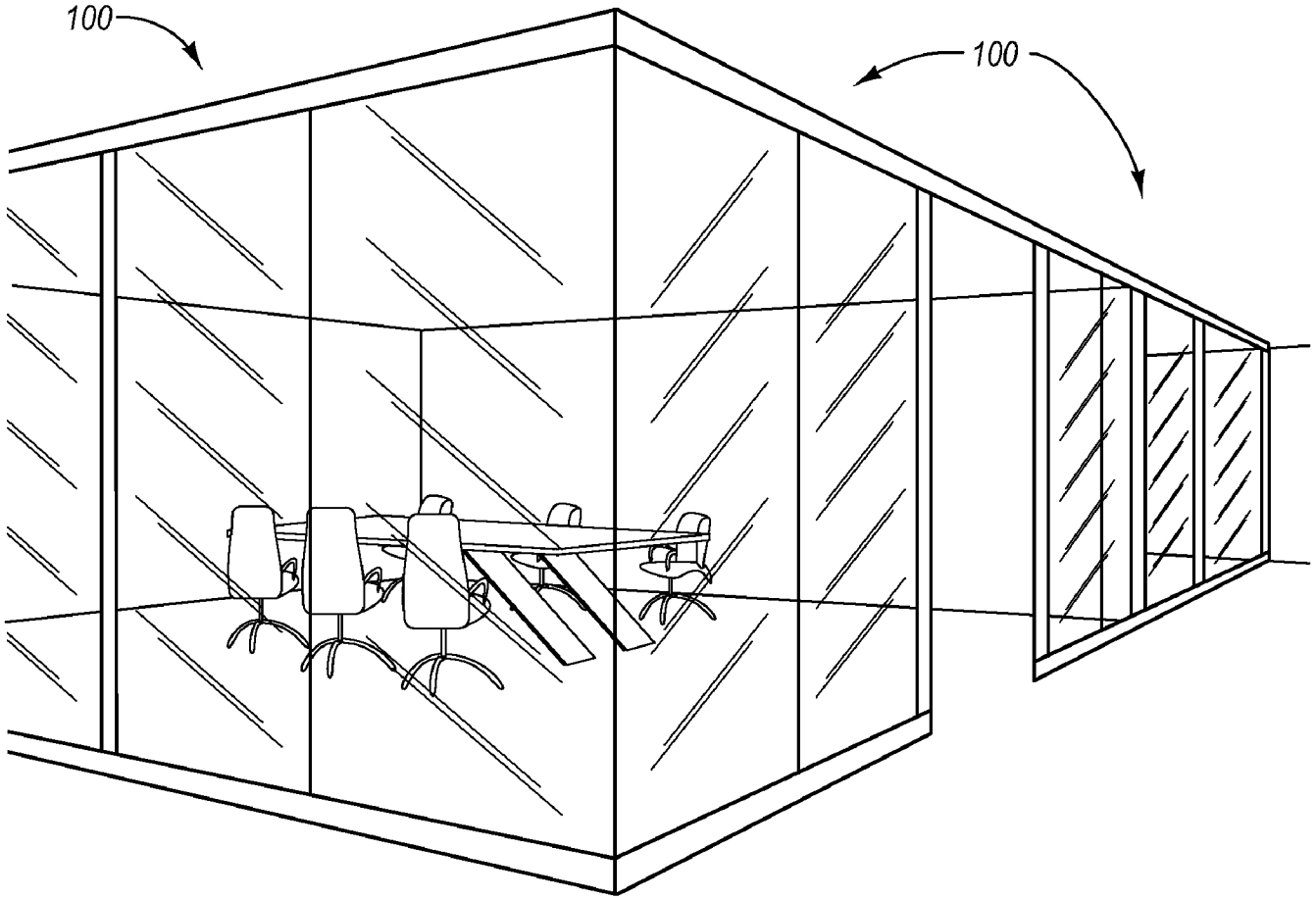
FIG. 7 illustrates yet another schematic diagram in which an office or conference room is built using panels that abut directly together at a corner, and thus without an additional vertical frame component.

For example, FIG. 7 illustrates an implementation in which an office or conference room is built using panels that abut directly together at a corner. In particular, FIG. 7 shows that vertically-laid panels can be used to form a corner without any structural components that would otherwise block the view through (or aesthetic of) the given panels 105. In one method of assembly, a manufacturer aligns a first set of panels vertically, as described herein. Thereafter, the manufacturer aligns a second set of panels to form a corner (simple abutment of panel edges). One will appreciate that a configuration such as this can allow a designer to provide an elegant corner with increased visibility through the corner region.

Figure 8:
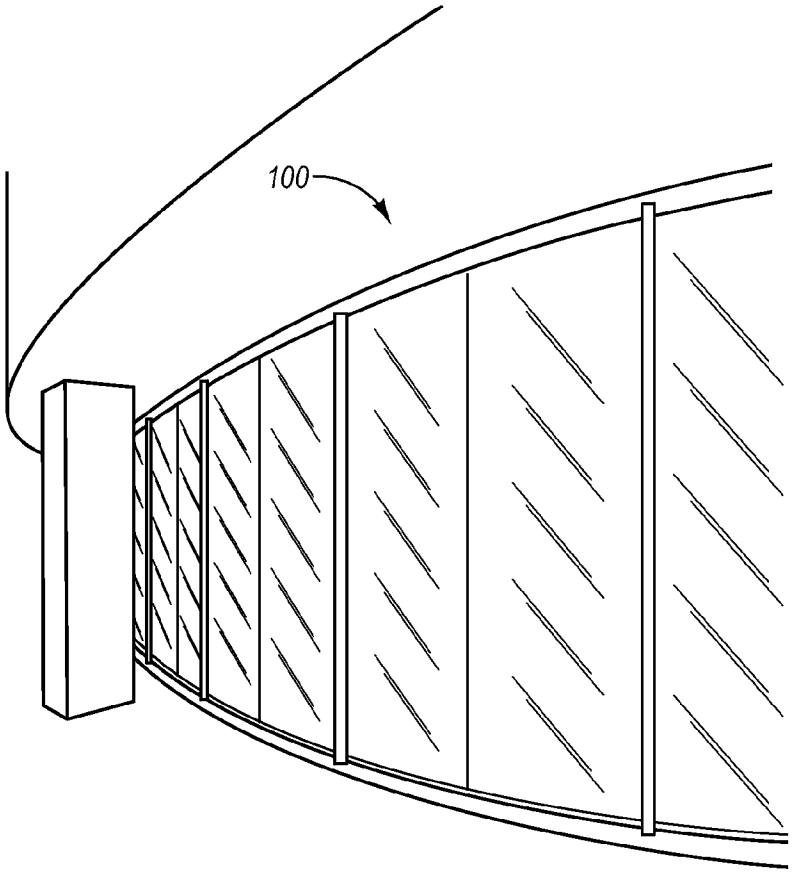
FIG. 8 illustrates a schematic diagram in which a conference room is built using vertically aligned panels in a curved formation.

In addition, and as previously mentioned, implementations of the present invention are particularly suited to satisfy other creative design choices with minimal cost, such as by providing curved partition alignments. For example, FIG. 8 illustrates an overview schematic in which a conference room is built using vertically aligned panels in a curved formation. In general, the partition of FIG. 8 can be created by aligning guide track 140 in a curved formation along a floor surface, and subsequently mounting lower horizontal frame component 115*a* along lower guide track 140, so that the horizontal frame component 115*a* takes on the curved shape. As will be appreciated, guide track 140 (just as frame component(s) 115) can also be formed from sufficiently flexible materials, such as flexible resins, rubber compounds, metals, or composites thereof, in order to accommodate any desired bend configurations. In addition to aligning the corresponding upper horizontal frame component 115*b* in a similar formation to component 115*a*, the manufacturer can then slide each given panel 105*a* in a horizontal or vertical alignment within slot 117, and without or without any intervening flexible separators 160 or vertical frame components 110 (e.g., FIG. 4).

Figure 9:
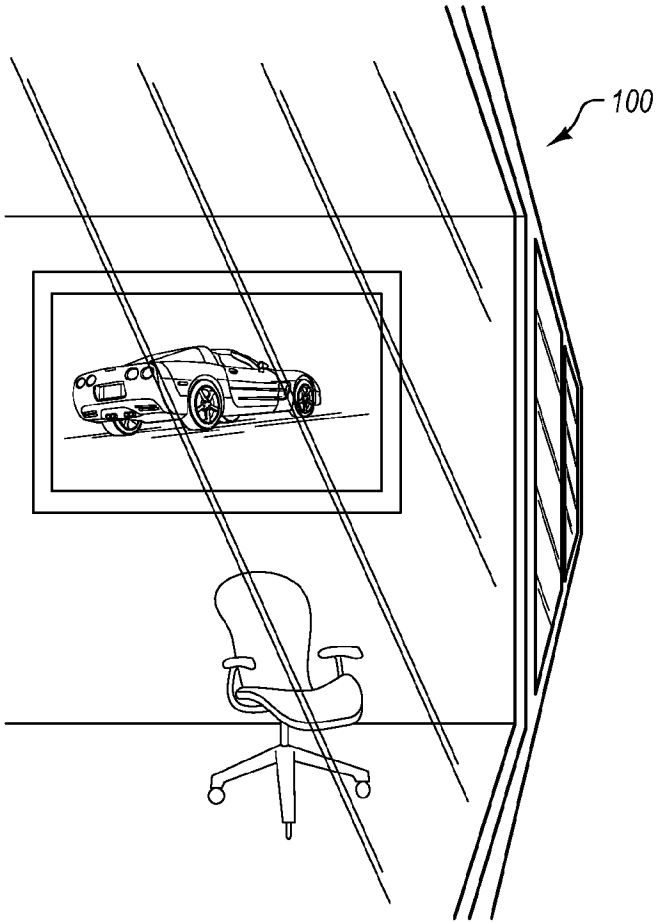
FIG. 9 illustrates a schematic diagram of a set of continuous partitions assembled in accordance with the partitions of FIG. 1.

Of course, an advantage of implementations of the present invention is that virtually any structural shape or length of partition is possible, despite only using relatively temporary, reusable components and materials. For example, FIG. 9 illustrates an overview schematic of a set of continuous partitions assembled in a long run. For example, a manufacturer can join several sets of partitions 100 (whether vertically or horizontally aligned) to create any small or large partition that is easily removable into another conformation, if desired.

Accordingly, the "stick-built" partitions/assemblies of the present as invention provide a number of different advantages, allowing a manufacturer to create the appearance of expensive, permanent partitions without the costs ordinarily required, and without the added costs that would otherwise be incurred through reconfigurations. In addition, implementations of the present invention allow partitions to be built on-site, and thus provide a great deal of flexibility and design freedom, both at the time of design, and subsequently during reconfiguration.

For example, a manufacturer (or virtually any member of the organization) can simply move a given partition by uncoupling the horizontal structural members from the structures to which they are secured. In many cases, persons performing the reconfiguration can even move an entire assembly as a unit. In other situations, the partition can be readily disassembled and reassembled at a separate location without incurring any damage to the given partition components.

In addition, although the implementations described herein relate primarily to just horizontally-laid or vertically-laid panels in a partition, one will appreciate that the components herein are flexible enough to mix these two types of alignments. For example, a manufacturer can easily join a horizontally-aligned partition with a vertically-aligned partition. In addition, a manufacturer can horizontally-align one panel against a lower frame component, and then align vertical frame components on top of the horizontally-laid frame components, and so forth. Accordingly, the components in accordance with implementations of the present invention allow for a wide range of design choices.

Furthermore, as a movable assembly, these partitions can be relocated as assembled where handling weight is acceptable and the relocation is within the same area. Still further, the partitions herein can be easily modified or configured to as connect to other components, such as sliding doors that would hang from a channel in the upper horizontal frame component (e.g., FIG. 6). As previously discussed, the partition assemblies herein can be further configured or otherwise modified with a particular component to connect to modular sections in the same manner with the same connectors, while still accepting any number of panels, or other types of substrate materials.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

We claim:

1. A partition system having a plurality of partitions which, when assembled, are used to subdivide an interior space on a semi-permanent or temporary basis, without damage to any component of a given partition when assembling it, moving it or reusing it, each partition comprising:

a first frame component configured to be removably mounted to a support surface, comprising a first slot therein for receiving an edge of one or more panels, and wherein the first frame component comprises a leveler assembly positioned therein beneath the first slot, the leveler assembly being configured to vertically adjust the first slot with respect to the support surface;

a second frame component;

a third frame component joined at one end to the first frame component and joined at an opposite end thereof to the second frame component;

two or more panels each constructed of a material such that each panel comprises four edges that are free of any obstruction or interlocking structure so that panel edges of at least two or more panels placed adjacent to one another come into direct contact with one another, but without otherwise interlocking or having any separate support structure;

at least one of said second and third frame components comprising a second slot therein for receiving an edge of one or more panels; and the first, second and third frame components, when joined together, forming a frame with one end thereof open for slidably receiving within said first and second slots at least two or more panels within the frame, with at least two or more panels having no structural support on at least one edge thereof when placed in the frame.

2. The partitioning system as recited in claim 1, wherein the second frame component is removably mounted to a ceiling support structure.

3. The partitioning system as recited in claim 2, wherein the second frame component further comprises:

a flexible insert configured to flexibly abut the ceiling structure as a form of adjustable trim; and one or more fasteners for direct attachment of the second frame component to the ceiling structure.

4. The partitioning system as recited in claim 1, wherein the second slot is formed in the second frame component and wherein the panels are mounted by sliding them within the slots of the first and second frame components.

5. The partitioning system as recited in claim 4, further comprising two additional frame components that are vertically oriented and are joined together with two different clips, the two additional frame components being positioned between two different panels.

6. The partitioning system as recited in claim 5, wherein the two additional frame components form at least one transverse slot when joined together.

7. The partitioning system as recited in claim 6, further comprising another panel positioned in the transverse slot, wherein the two additional frame components removably hold at least three different panels.

8. The partitioning system as recited in claim 4, further comprising a fourth frame component mounted between the first and second frame components, the fourth frame component including a slot therein for receiving at least one side of at least one of the panels.

9. The partitioning system as recited in claim 8, wherein the second slot is formed in the third frame component joined between the first and second frame components, and wherein the panels are mounted in a horizontal configuration so that:

the third and fourth frame components are oriented in a vertical fashion and include a corresponding plurality of different panel edges positioned in a respective slot of the third and fourth frame components; and the first and second frame components are oriented in a horizontal fashion and have only one edge of one of the panels positioned in said first slot of the first frame component.

10. The partitioning system as recited in claim 1, wherein the third frame component is positioned against a support structure.

11. The partitioning system as recited in claim 10, wherein:

the support structure is a modular wall; and the third frame component comprises a flexible insert configured to interface directly with the modular wall without attachment.

12. The partitioning system as recited in claim 10, wherein:

the support structure is a permanent wall; and the third frame component comprises a connector plate and one or more fasteners that attach the third frame component directly to the support structure.

13. A partition system having a plurality of partitions which, when assembled, are used to subdivide an interior space on a semi-permanent or temporary basis, without damage to any component of a given partition when assembling it, moving it or reusing it, each partition comprising:

first and second frame components each having first and second ends, at least one of the first and second frame components comprising a first slot therein for receiving an edge of one or more panels, and further comprising a leveler assembly positioned beneath the first slot, the leveler assembly being configured to vertically adjust the first slot with respect to the support surface;

a third frame component joined at opposite ends thereof to the first ends of the first and second frame components;

a fourth frame component joined at opposite ends thereof to the second ends of the first and second frame components;

three or more panels each constructed of a material such that each panel comprises four edges that are free of any obstruction or interlocking structure so that panel edges of at least two or more panels placed adjacent to one another come into direct contact with one another, but without otherwise interlocking or having any separate support structure;

each of said frame components comprising a slot therein for receiving an edge of one or more panels;

said frame components, when joined together, forming an enclosed frame with said three or more panels secured therewithin, with at least two panels being secured on not more than three edges within the slots of three of the frame components, and with at least a third panel being secured on not more than two edges with the slots of two of the frame components, and the at least third panel having no structural support by any frame component on at least two edges thereof when placed in the frame.

14. The partition system of claim 13, wherein said panels are made of glass or resin.

15. The partition system of claim 13, further comprising:

a plurality of clips attached to at least one of the first and second frame components and attached to the third frame component; and a flexible surface member attached to the plurality of clips and configured to appear as a permanent attachment.

16. The partition system of claim 13, wherein the plurality of partitions are assembled to form a partition system having at least one wall formed by the assembled partitions that is in a non-linear configuration.

17. The partition system of claim 13, further comprising a gasket positioned in each slot.

18. The partition system of claim 1, further comprising a gasket positioned in each slot.

* * * * *

UNITED STATES PATENT AND TRADEMARK OFFICE

CERTIFICATE OF CORRECTION

PATENT NO. : 8,015,766 B2
APPLICATION NO. : 11/742591
DATED : September 13, 2011
INVENTOR(S) : Gosling et al.

It is certified that error appears in the above-identified patent and that said Letters Patent is hereby corrected as shown below:

Column 3
Line 58, after "in a" remove [as]

Column 5
Line 28, change "minimize" to --minimized--

Column 6
Line 19, change "number synthetic" to --number of synthetic--

Column 7
Line 25, before "first inserts" remove [as]
Line 53, change "in a lengths" to --in lengths--

Column 8
Line 24, after "manufacturer" remove [as]
Line 59, after "in size" remove [as]

Column 9
Line 49, change "alternatively" to --alternative--

Column 10
Line 6, change "in a manufacturer" to --in which a manufacturer--
Line 25, before "preliminary assembly 200" remove [as]
Line 59, unbold "12""

Column 11
Line 45, change "without or without" to --with or without--
Line 57, after "present" remove [as]

Signed and Sealed this
Twenty-first Day of February, 2012

David J. Kappos

David J. Kappos
*Director of the United States Patent and Trademark Office*

Column 12
Line 21, after “configured to” remove [as]